US005894201A

United States Patent [19]

Wong

[11] Patent Number: 5,894,201

[45] Date of Patent: Apr. 13, 1999

[54] LIGHT FLASHING SYSTEM

[75] Inventor: Wai Kai Wong, Hong Kong, The Hong Kong Special Administrative Region of the People's Republic of China

[73] Assignee: Cheerine Development (Hong Kong) Ltd

[21] Appl. No.: 08/963,695

[22] Filed: Nov. 4, 1997

[51] Int. Cl.[6] ..... H05B 37/00

[52] U.S. Cl. ..... 315/241 S; 315/76; 362/103; 362/265

[58] Field of Search ..... 315/241 S, 323, 315/76, 225, 224; 362/103, 265, 800, 802; 66/137, 136

[56] References Cited

U.S. PATENT DOCUMENTS

| | | | |
|---|---|---|---|
| 5,188,447 | 2/1993 | Chiang et al. | 362/103 |
| 5,422,628 | 6/1995 | Rodgers | 340/573 |
| 5,457,900 | 10/1995 | Roy | 315/323 X |
| 5,461,188 | 10/1995 | Drago et al. | 84/600 |
| 5,644,858 | 7/1997 | Bemis | 36/137 |

*Primary Examiner*—Don Wong
*Assistant Examiner*—Haissa Philogene
*Attorney, Agent, or Firm*—Brinks Hofer Gilson & Lione

[57] ABSTRACT

A light flashing system for flashing lights on and off and for generating a pattern of illumination for a plurality of lights in response to intermittent switch closures. The system includes a battery, a plurality of light emitting elements, a plurality of transistors which enable the illumination of the light emitting elements, a switch, a capacitor, and a pattern generation circuit. The battery powers the light emitting elements and the pattern generation circuit. The switch intermittently clocks the pattern generation circuit and enables the flow of current in certain of the transistors, allowing illumination of certain of the light emitting elements in response to changes in inertial forces caused by movement of the flashing light system. The capacitor is connected in parallel to the battery such that the capacitor stores electrical charge when the switch is closed and continues to enable the flow of current through certain of the transistors after the switch is opened. The pattern generation circuit then causes at least one, but not necessarily all, of the plurality of light emitting elements to illuminate by enabling the flow of current through certain of the transistors. As the switch intermittently opens and closes, the pattern generation circuit is clocked through various states, and the outputs of the pattern generation circuit enables the flow of current through certain of the transistors, allowing illumination of at least one, but not necessarily all, of the light emitting elements in a pattern.

28 Claims, 3 Drawing Sheets

LIGHT FLASHING SYSTEM

BACKGROUND OF THE INVENTION

This invention relates generally to footwear and more particularly to an improved system for selectively illuminating lighting devices incorporated into footwear.

It is well known to incorporate lighting devices into footwear. Lighting devices have been incorporated into a wide variety of footwear including athletic shoes and dress shoes. The incorporation of lighting devices in footwear enables the wearer to be more easily seen, especially when visibility is reduced due to inclement weather conditions or darkness. Intermittent illumination, or flashing, of these lighting devices further increases the wearer's ability to be seen as flashing lighting devices are more readily perceived by others.

There are known in the art several different implementations of footwear lighting systems that produce flashing lights. These implementations typically rely on the opening and closing of a switch to create the flashing effect. Many different types of switches have been used to create this effect. For example, pressure switches, mercury switches, and spring switches have all been used to generate flashing lights in footwear. However, in all of these systems, flashing only occurs in response to the connection or disconnection of the circuit created by the opening and closing of the switch. Furthermore, in systems with a plurality of lights, the lights are illuminated in unison, with all of the lights being illuminated at the same time.

There are also known in the art implementations of footwear lighting systems that control the illumination of a plurality of lights through a series of illumination patterns independent of changes in inertial forces on the system. Such systems, however, have been very complex and require complex control circuits to operate. For example, U.S. Pat. No. 5,457,900 to Roy, titled "Footwear Display Device," selectively illuminates certain ones of a plurality of lights in response to a velocity measurement made by the system and a control circuit containing a predetermined pattern of illumination. Once this system begins to operate, it steps through a series of illumination patterns in which the pattern of illuminated lights changes in response to the passage of time and without regard to any changes in inertial forces on the system. The steps are recorded in a complex control circuit and require the measurement of the velocity of the moving footwear to determine the duration of the changing patterns of illumination.

SUMMARY OF THE INVENTION

The present invention incorporates a power source, a plurality of light emitting elements, a plurality of gates, a switch, a capacitor, and a pattern generation circuit to create changing patterns of flashing lights that can be utilized in footwear. The system creates different patterns of illuminated light by utilizing a pattern generation circuit to selectively enable the illumination of one or more light emitting elements from a plurality of light emitting elements. The system creates the flashing effect by utilizing a switch which is opened and closed due to changes in inertial forces acting on the footwear incorporating the invention. The switch clocks the pattern generation circuit which, in turn, enables the illumination of the light emitting elements. The result is a system that flashes various combinations of light emitting elements from a plurality of light emitting elements in response to the movement of the footwear. The changes in the combination of the illuminated light emitting elements from the plurality of light emitting elements only occur in response to changes in inertial forces on the system and independent of time.

These and other features and advantages of the invention will be apparent upon consideration of the following detailed description of the preferred embodiments of the invention, taken in conjunction with the appended drawings.

DETAILED DESCRIPTION OF THE PRESENTLY PREFERRED EMBODIMENTS

Figure 1:
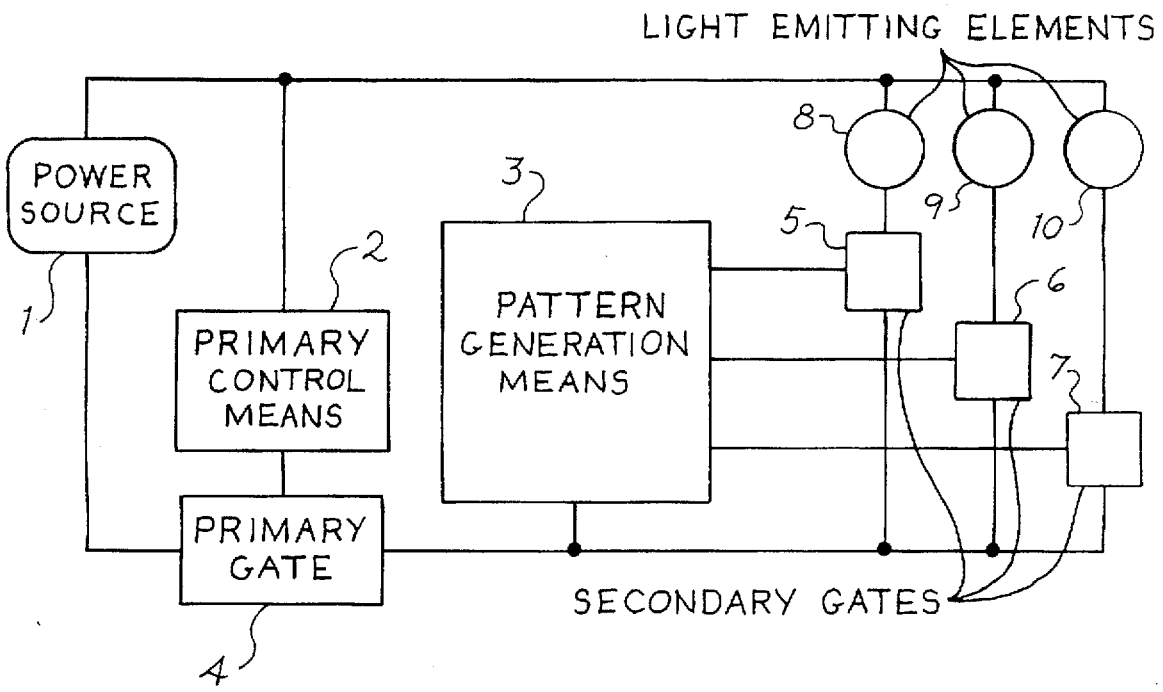
FIG. 1 is a block diagram of a preferred embodiment of a light flashing system accordance with the invention.

Referring to FIG. 1, a power source 1 is connected to a primary gate 4, a primary control means 2 for the primary gate 4, a plurality of light emitting elements 8, 9, and 10, secondary gates 5, 6, and 7, and a pattern generation means 3 for generating a pattern of signals to control the secondary gates 5, 6, and 7. The primary control means 2 controls the opening and closing of the primary gate 4. When the primary gate 4 is open, it enables the flow of current through the circuit, allowing the circuit to operate. The pattern generation means 3 generates a pattern of signals and each generated signal separately controls the opening and closing of a respective secondary gate 5, 6, or 7. Secondary gate 5 is connected to light emitting element 8, secondary gate 6 is connected to light emitting element 9, and secondary gate 7 is connected to light emitting element 10. When any of the secondary gates 5, 6 and 7 are open and the primary gate is open, the current flows through the respective light emitting element 8, 9, and 10, allowing the respective light emitting element to illuminate. In a preferred embodiment, the power source 1 is a battery, the primary gate 4 and secondary gates 5, 6, and 7 are transistors, the primary control means 2 is a switch, the pattern generation means 3 is a pattern generation circuit (e.g., a counter), and the light emitting elements 8, 9, and 10 are light emitting diodes (LEDs).

Note that, as used herein, the terms "connected" and "electrically connected" are defined to include a direct connection of two or more elements, or to include an indirect connection of two or more elements connected through one or more other elements. For example, the power source 1 is connected to the light emitting elements 8, 9, and 10 through the primary gate 4 and the secondary gates 5, 6, and 7.

Figure 2:
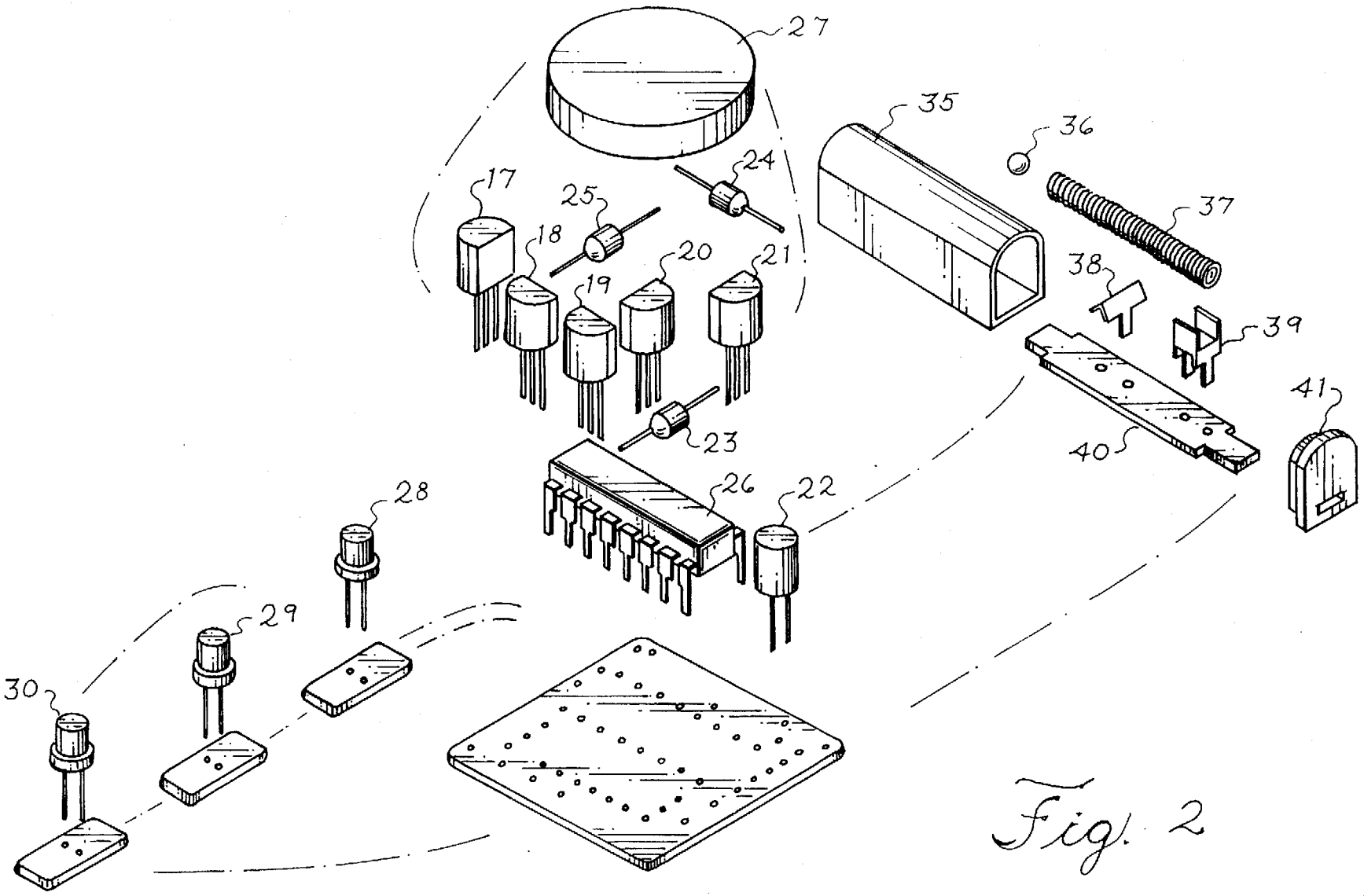
FIG. 2 ia an exploded view of a preferred embodiment of a light flashing system in accordance with the invention.
Figure 3:
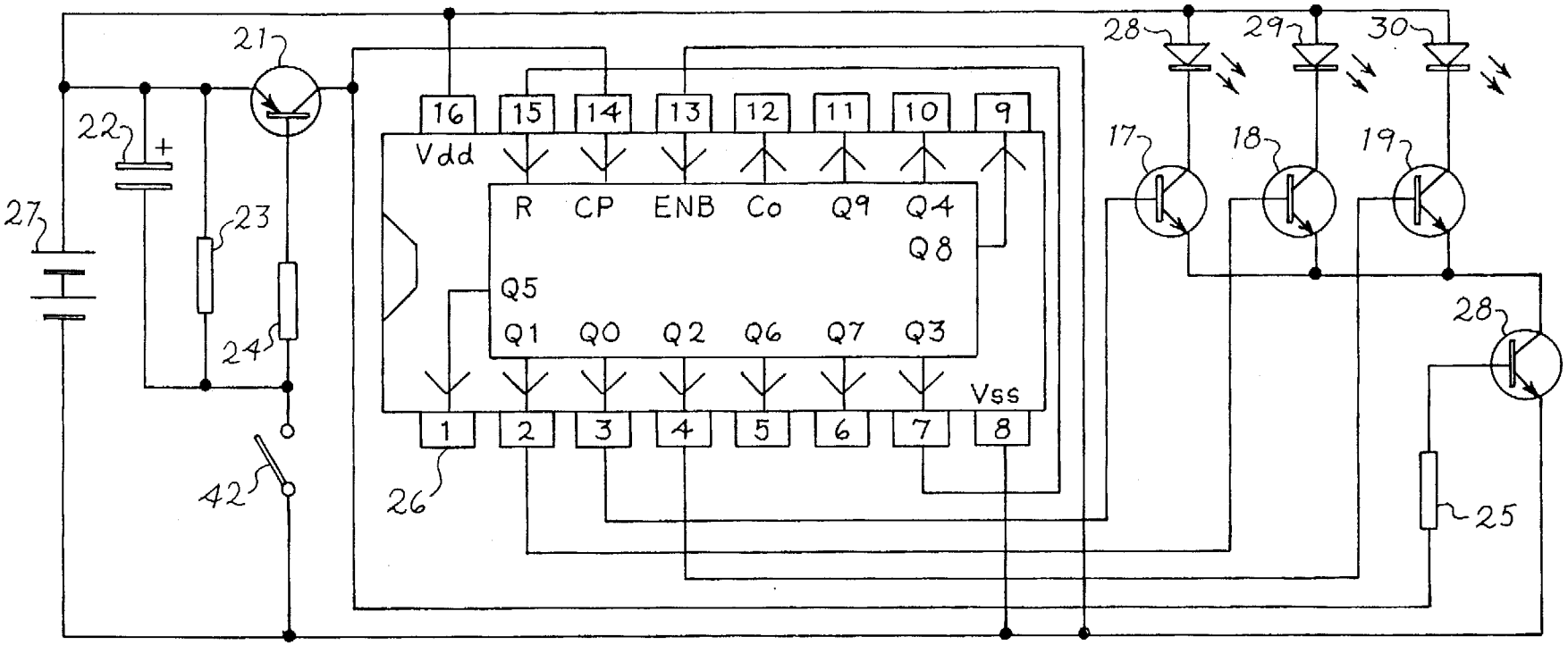
FIG. 3 is a schematic diagram of a preferred embodiment of a light flashing system in accordance with the invention.

Referring now to FIGS. 2 and 3, the present invention creates a desired visual effect by intermittently and selectively illuminating certain ones of a plurality of light emitting diodes (LEDs) 28, 29, and 30. A battery 27 is used as a power source for illuminating the plurality of LEDs 28, 29, and 30 and powering a pattern generation circuit 26. The battery 27 is preferably a three volt battery. A switch 42 (FIG. 3) intermittently clocks the pattern generation circuit 26, which then enables the flow of current through certain ones of the LEDs 28, 29, and 30, causing them to illuminate, each time the switch 42 is closed. The switch 42 may be a switch incorporating a spring, a pressure sensitive switch, a mercury switch, a buzzer switch, or any other suitable type of switch. The switch is shown in the preferred embodiment as incorporating a spring 37. The intermittent illumination of the LEDs 28, 29, and 30 results in a "flashing" effect as certain ones of the LEDs 28, 29, and 30 are illuminated in response to the clocking of the pattern generation circuit 26 by the closing of the switch 42.

The battery 27 provides power to the LEDs 28, 29, and 30 and the pattern generation circuit 26. The LEDs 28, 29, and 30 are connected selectively in series with the battery 27 through secondary gates, which are secondary transistors 17,18, and 19 in the preferred embodiment, respectively, and a primary gate, which is a primary transistor 20 in the preferred embodiment. Three LEDs 28, 29, and 30 are shown in the present embodiment; however, any number of LEDs can be used. Furthermore, any combination of different color LEDs can be used.

In one embodiment, the primary control means, which controls the primary gate, is a switch 42, which comprises a first contact point 39, a second contact point 38, and a spring 37. The first contact point 39 is fixed to a first end of the spring 37. The first contact point 39 comprises a holder that is capable of receiving the spring 37 such that the two are electrically connected. Preferably, the spring 37 is soldered to the first contact point 39. The spring 37 is connected only at one end such that the other end is free to move in at least one range of motion in response to an inertial force applied to the system. In an alternative embodiment, the spring 37 may be equipped with a weight 36 added to the unconnected end to enhance the deflection of the spring 37 in response to the inertial force. The weight 36 could be made of metal, plastic, ceramic, or other suitable material that has a sufficient mass to enhance the deflection of the spring.

The second contact point 38 is positioned with respect to the spring 37 such that it is not normally connected (i.e., normally open). The second contact point 38 is oriented such that the spring 37 contacts the second contact point 38 when the spring 37 deflects in response to the inertial force. In alternative embodiments, any type of deflection member can be used to cause contact between the first contact point 39 and the second contact point 38.

Referring again to FIG. 3, a means for generating a pattern of signals is a pattern generation circuit 26 in the preferred embodiment. The pattern generation circuit 26 serves to alter the pattern of illumination of the LEDs 28, 29, and 30 in response to changes in inertial forces on the system. The pattern generation circuit 26 comprises a counter having three outputs Q0, Q1, and Q2. The pattern generation circuit 26 is powered by the battery 27 and is intermittently clocked by the closure of switch 42. The switch 42 is connected to a transistor 21. The closure of switch 42 enables the flow of current through transistor 21, the pattern generation circuit 26 is incremented by one count, and the output of the pattern generation circuit 26 changes accordingly. The output of the pattern generation circuit at each of Q0, Q1, and Q2 is a voltage that is either 0 volts or 3 volts. These outputs are the three lowest positions of the binary sequence of the decade counter. Thus when any of the states Q0, Q1, or Q2 is a binary 1, the output is 3 volts.

Alternatively, when Q0, Q1, or Q2 is a binary 0, the output is 0 volts. The voltage at each output changes as the counter is incremented.

The changing output voltages of Q0, Q1, and Q2 are used to selectively enable the flow of current through the secondary gates (secondary transistors 17, 18 and 19) in a pattern which, in turn, illuminates LEDs 28, 29, and 30 in a pattern. The pattern generation circuit is preferably an integrated circuit (e.g., MC14017BCP, CD4017AF). In an alternative embodiment, the pattern generation circuit and the external electronic components such as the transistors, capacitor, and resistors can be integrated into a CMOS circuit.

The secondary transistors 17, 18, and 19 control the pattern of illumination of the LEDs 28, 29, and 30 by either enabling the flow of current through the LEDs or disabling the flow of current through the LEDs, depending on the output of the pattern generation circuit. The secondary transistor 17 controls the illumination of LED 28 while transistor 18 controls the illumination of LED 29, and secondary transistor 19 controls the illumination of LED 30. The bases of secondary transistors 17, 18, and 19 are respectively connected to the outputs Q0, Q1, and Q2 of the pattern generation circuit 26, and the collectors of secondary transistors 17, 18, and 19 are respectively connected to the LEDs 28, 29, and 30. Thus, the outputs Q0, Q1, and Q2 of the pattern generation circuit 26 control the illumination of the LEDs by enabling or disabling the flow of electrical current through the LEDs.

The primary gate (primary transistor 20) enables the flow of current through each of the LEDs and secondary transistors 17, 18, and 19 when the switch 42 is closed. In the preferred embodiment, a capacitor 22 is connected in parallel with the battery 27. The capacitor 22 stores electrical charge when the switch 42 is closed and continues to enable the flow of current through transistor 21 and primary transistor 20 after the switch 42 is opened. The capacitor 22 will continue to enable the flow of current through transistor 21 and primary transistor 20, allowing certain ones of LEDs 28, 29, and 30 to illuminate until the voltage emitted from the capacitor 22 falls below 0.7 volts. The preferred capacitance of the capacitor 22 is 1 microfarad.

Additionally, resistors 23, 24, and 25 are provided to manage the amount of electrical current at various points in the circuit, as is well known to those skilled in the art. The preferred resistance values of the resistors are as follows: resistor 23, 150 kilo-ohms; resistor 24, 3.3 kilo-ohms; and resistor 25, 5.1 kilo-ohms.

In a preferred embodiment, the switch 42 is encased in a switch housing 35 that is closed at one end and open at the other end. The switch housing 35 is sized and shaped to receive the switch 42. The open end of the switch housing is then sealed by the endplate 41. The switch housing is designed to allow the switch 42 within the switch housing to remain in electrical connection with the rest of the system not located within the switch D housing 35. The remainder of the system, including the battery 27, secondary transistors 17, 18, and 19, primary transistor 20, transistor 21, pattern generation circuit 26, capacitor 22, and resistors 23, 24, and 25, along with the switch housing 35 containing the switch 42, are encased in a plastic housing.

Figure 4:
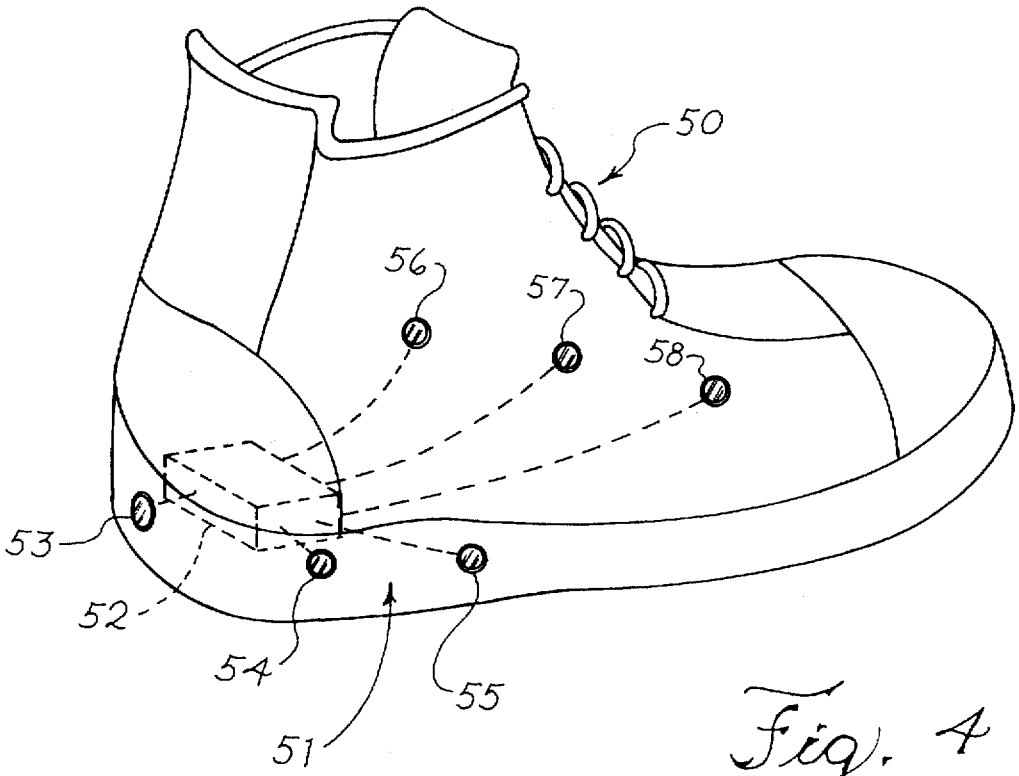
FIG. 4 is a diagram of an article of footwear containing a light flashing system of a preferred embodiment within a sole of the footwear.

Referring to FIG. 4, a plastic housing 52 containing the components of a light flashing system is inserted into the sole 51 of footwear 50 in a manner that is well known in the art, and LEDs 53, 54, 55, 56, 57 and 58 are mounted so that they are visible on the outer surface of the footwear 50. It should be noted that any number of LEDs may be used and may be mounted in any position on the footwear 50.

The circuitry is designed to be adaptable into footwear 50. In operation, the spring 37 deflects in response to changes in inertial forces acting on the system. The changes in inertial forces result from movement of the system, such as by the user's foot striking the ground due to a walking or running motion. The deflection of the spring 37 results in the spring 37 contacting the second contact point 38 and effectively closing the switch 42.

The closure of the switch 42 clocks the pattern generation circuit 26 thereby changing the voltage at the outputs Q0, Q1, and Q2 of the pattern generation circuit 26. Also, when the switch 42 is closed, current flows through the capacitor 22 and enables current to flow in transistor 21 and primary transistor 20, allowing current to flow selectively through secondary transistors 17,18, and 19 and LEDs 28, 29, and 30. The changing output voltages of the pattern generation circuit 26 drive the secondary transistors 17, 18, and 19 that are connected to both the outputs Q0, Q1, and Q2 and the LEDs 28, 29, and 30. The output voltages drive the secondary transistors 17, 18, and 19 such that the flow of current through each LED 28, 29, and 30 and each secondary transistor 17,18, and 19 is either enabled or disabled. If the flow of current is enabled, the LEDs 28, 29, and 30 will light. If the flow of current is disabled, the LEDs 28, 29, and 30 will not light.

As the spring 37 moves in the opposite direction so as not to contact the second contact plate 38, the switch 42 is open. After the switch 42 opens, the capacitor 22 continues to provide current to the transistor 21 and the primary transistor 20, which, in turn, allows the battery to illuminate selective ones of the LEDs 28, 29, and 30. Thus, selective ones of the LEDs 28, 29, and 30 will continue to be illuminated after the switch 42 is opened until the voltage in the capacitor 22 falls below 0.7 volts. The entire process is repeated each time the switch 42 is closed, creating the effect of flashing the LEDs 28, 29, and 30 in a pattern each time an inertial force is applied to the system.

The present invention, therefore, allows a system for illuminating certain ones of a plurality of light emitting elements in response to a change in the inertial forces on the system. The illumination of the light emitting elements is controlled by gates which enable the flow of current through the light emitting elements. The gates are able to be controlled through the use of transistors and a simple pattern generation circuit. The pattern of illuminated light emitting elements changes only in response to changes in the inertial forces on the system and is independent of the passage of time. This allows the system to operate in response to the footwear striking the ground and does not require clocking a circuit through various states or measurement of velocity of the footwear to control the changing patterns of illuminated light emitting elements.

It is to be understood that a wide range of changes and modifications to the embodiments described above will be apparent to those skilled in the art and are contemplated. It is therefore intended that the foregoing detailed description be regarded as illustrative rather than limiting, and that it be understood that it is the following claims, including all equivalents, that are intended to define the spirit and scope of the invention.

I claim:

1. A lighting system to be incorporated into footwear comprising:

a power source;

a primary gate electrically connected to the power source;

means for controlling the primary gate, said means for controlling electrically connected to the primary gate and the power source;

a plurality of secondary gates each electronically connected to the primary gate and the power source;

a plurality of light emitting elements each electrically connected to a respective one of the plurality of secondary gates, to the primary gate, and to the power source; and means for generating a pattern of signals which control the secondary gates, said means for generating electrically connected to the plurality of secondary gates and the power source.

2. The lighting system of claim 1, wherein the means for controlling the primary gate comprises a switch electrically connected to the power source and the primary gate.

3. The lighting system of claim 2, further comprising means for enabling the light emitting elements to illuminate after the switch is opened, said means for enabling being electrically connected in parallel to the power source.

4. The lighting system of claim 3, wherein the means for enabling comprises a capacitor.

5. The lighting system of claim 2, wherein the switch comprises a spring having first and second ends, wherein the first end is fixed to a first contact point which is electrically connected to the power source and the second end is disposed above a second contact point which is electrically connected to the primary gate such that the second end of the spring contacts the second contact point in response to changes in inertial forces applied to the footwear to create an electrical connection between the spring and the second contact point.

6. The lighting system of claim 5, wherein the switch further comprises a mass attached to the second end of the spring to facilitate the connection of the spring and the second contact point.

7. The lighting system of claim 1, wherein the plurality of light emitting elements comprise light emitting diodes.

8. The lighting system of claim 1, wherein the means for generating a pattern of signals comprises an integrated circuit.

9. The lighting system of claim 2, wherein the means for generating a pattern of signals comprises a counter.

10. The lighting system of claim 9, wherein the counter is incremented each time the switch is closed.

11. The lighting system of claim 1, wherein the primary gate and secondary gates comprise transistors.

12. A method of generating a flashing pattern of light illuminations for use with footwear, the method comprising the steps of:

providing a power source;

controlling a primary gate connected to the power source;

providing a plurality of secondary gates each electrically connected to the primary gate and the power source;

providing a plurality of light emitting elements each connected to a respective one of the plurality of secondary gates, to the primary gate and to the power source; and generating a pattern of signals to control the secondary gates.

13. A lighting system to be incorporated into footwear comprising:

a power source;

a plurality of light emitting elements electrically connected to the power source;

means for illuminating a pattern of at least one, but not all, of the light emitting elements, wherein the pattern of the illuminated light emitting elements is changed only in response to changes in inertial forces on the lighting system, said means for generating electrically connected to the plurality of light emitting elements and the power source.

14. The lighting system of claim 13, wherein the means for illuminating comprises an integrated circuit electrically connected to the power source and a switch connected to the integrated circuit and the power source.

15. The lighting system of claim 14, wherein the switch comprises a spring having first and second ends, wherein the first end is fixed to a first contact point which is electrically connected to the power source and the second end is disposed above a second contact point which is electrically connected to the means for generating a pattern of signals such that the second end of the spring contacts the second contact point in response to changes in inertial forces applied to the footwear to create an electrical connection between the spring and the second contact point.

16. The lighting system of claim 15, wherein the switch further comprises a mass attached to the second end of the spring to facilitate the connection of the spring and the second contact point.

17. The lighting system of claim 13, wherein the plurality of light emitting elements comprise light emitting diodes.

18. Footwear containing a lighting system comprising:

a shoe having a sole;

a power source disposed in the sole of the shoe;

a primary gate electrically connected to the power source and disposed in the sole of the shoe;

means for controlling the primary gate electrically connected to the primary gate and the power source and disposed in the sole of the shoe;

a plurality of secondary gates each electrically connected to the primary gate and the power source and disposed in the sole of the shoe;

a plurality of light emitting elements disposed in the sole of the shoe so that the plurality of light emitting elements are visible external to the shoe, wherein each of the plurality of light emitting elements are electrically connected to a respective one of the plurality of secondary gates, to the primary gate, and to the power source; and means for generating a pattern of signals which control the secondary gates, said means for generating electrically connected to the secondary gates and the power source and disposed in the sole of the shoe.

19. The footwear of claim 18, wherein the means for controlling the primary gate comprises a switch electrically connected to the power source and the primary gate.

20. The footwear of claim 19, further comprising means for enabling the light emitting elements to illuminate after the switch is opened, said means for enabling being electrically connected in parallel to the power source and disposed in the sole of the shoe.

21. The footwear of claim 20, wherein the means for enabling comprises a capacitor.

22. The footwear of claim 19, wherein the switch comprises a spring having first and second ends, wherein the first end is fixed to a first contact point which is electrically connected to the power source and the second end is disposed above a second contact point which is electrically connected to the primary gate such that the second end of the spring contacts the second contact point in response to changes in inertial forces applied to the footwear to create an electrical connection between the spring and the second contact point.

23. The footwear of claim 22, wherein the switch further comprises a mass attached to the second end of the spring to facilitate the connection of the spring and the second contact point.

24. The footwear of claim 18, wherein the plurality of light emitting elements comprise light emitting diodes.

25. The footwear of claim 18, wherein the means for generating a pattern of signals comprises an integrated circuit which is disposed in the sole of the shoe.

26. The footwear of claim 19, wherein the means for generating a pattern of signals comprises a counter disposed in the sole of the shoe.

27. The footwear of claim 26, wherein the counter is incremented each time the switch is closed.

28. The footwear of claim 18, wherein the primary gate and secondary gates comprise transistors.

* * * * *